US005478232A

United States Patent [19]

Dillinger et al.

[11] Patent Number: 5,478,232

[45] Date of Patent: Dec. 26, 1995

[54] AMBIENT LIGHT CONTROLLED OUTDOOR GAS LIGHT

[75] Inventors: Bill R. Dillinger, Brunswick, Ohio; John M. Crawford, Duluth, Ga.

[73] Assignee: TrimbleHouse Corporation, Norcross, Ga.

[21] Appl. No.: 216,103

[22] Filed: Mar. 22, 1994

[51] Int. Cl.[6] ..... F23Q 7/12

[52] U.S. Cl. ..... 431/255; 431/18; 431/86; 431/100

[58] Field of Search ..... 431/255, 18, 100, 431/86, 87

[56] References Cited

U.S. PATENT DOCUMENTS

| | | | |
|---|---|---|---|
| 3,330,133 | 7/1967 | Kniebes | 431/18 |
| 3,723,045 | 3/1973 | Reese | 431/18 |
| 3,837,787 | 9/1974 | Remy et al. | 431/255 |
| 4,830,606 | 5/1989 | Dillinger | 431/255 |
| 4,870,314 | 9/1989 | Hefling | 431/255 X |

*Primary Examiner*—Larry Jones
*Attorney, Agent, or Firm*—Hopkins & Thomas

[57] ABSTRACT

An outdoor lamp has a solenoid valve which controls the feed of gas and mixed with air to an electrically conducting venturi table and thence to burner tips which are surrounded by mantles. An electrode disposed adjacent to a slit in the venturi tube creates a spark adjacent to the slit when the valve is electrically opened to light the gas mixture which subsequently lights the gas mixture at the tips. An electrical circuit has a photocell array which causes the electrical circuit to open the valve at dawn with a shot of electricity and closes the valve at night with another shot of electricity. A sensor in the circuit detects when the lamp is lighted and discontinues the spark.

24 Claims, 5 Drawing Sheets

AMBIENT LIGHT CONTROLLED OUTDOOR GAS LIGHT

FIELD OF INVENTION

This invention relates to gas light and is more particular concerned with an ambient light controlled outdoor gas light.

BACKGROUND OF THE INVENTION

In the past, many outdoor gas lights have been produced which use two mantles suspended from a gas manifold which, in turn, is supported by an upright venture tube. The combustible mixture of air and illuminating gas, fed to the burner tips, within the mantles, are usually manually lighted, externally through the mantle, each time it is necessary to light the gas mixture. Therefore, usually the outdoor gas lamp is constructed to remain lighted, continuously until a new mantle is required.

In my U.S. Pat. No. 4,830,606, issued May 16, 1989, entitled "GAS LAMP AND CONTROL THEREFOR", I have disclosed an electrical control system in which a solar cell recharges a rechargeable battery, and also controls the operation of a normally open, electromagnetic, gas valve, held closed by an electrical current. An ignitor system for each mantle is provided so that electrodes are fired on a daily basis through the mantle each time the valve is permitted to open.

The present invention does away with the necessity of providing individual ignitors for each mantle and provides an electrical circuit in which so little electricity is used that the battery need not be rechargeable and will last for an extended period or can be readily maintained in a charged condition by the solar cell.

SUMMARY OF THE INVENTION

Briefly described, the present invention includes a tube through which a combustible mixture passes and an electrical ignition and valve control system for lighting a combustible mixture within the tube so that it then lights the combustible mixture to burn at a discharge end. The discharge end is usually surrounded by a mantle which is heated to incandescence by the flame. In greater detail, the preferred embodiment of the invention includes an upstanding venturi tube which delivers a combustible mixture of illuminating gas and air to a horizontally disposed manifold having two, or more, downwardly directed ceramic mantle tips around which are disposed the mantles. The venturi tube is provided with two horizontal slits extending circumferentially around a portion of the venturi. The venturi is made of an electrical conducting metal and an electrode is disposed adjacent to the slits to provide an electrical spark gap between the electrode and the venturi, adjacent the two slits, for lighting the gas mixture so that the lighted gas then simultaneously lights the mantle tips.

The electrical circuitry includes a double-acting solenoid valve which is opened by a momentary flow of electricity, simultaneously with the firing of the electrode for supplying a gas stream through the venturi and the manifold to the mantles, at a rate sufficient that, when the gas stream is lighted, there is no back firing through the venturi. The electrode is disabled when a light detecting, i.e., infrared sensor, detects that the lamp is lighted. Accordingly, it is an object of the present invention to provide an outdoor gas lamp in which a plurality of burner tips on the lamp are simultaneously lighted.

Another object of the invention is to provide an outdoor gas lamp which is inexpensive to manufacture, durable in structure, efficient in operation and requires little maintenance.

Another object of the present invention is to provide an outdoor gas lamp which will use a minimum amount of electricity to open and close the gas valve and automatically light the lamp.

Another object of the present invention is to provide an outdoor gas lamp which will stop sparking and shut off the valve supplying the gas stream after a predefined time period if the outdoor gas lamp does not light.

Another object of the invention is to provide a self-igniting light controlled gas lamp which uses a conventional battery which needs no appreciable recharging.

Another object of the present invention is to provide an outdoor gas lamp which will utilize a minimum amount of illuminating gas during a 24 hour period.

Another object of the present invention is to provide in an outdoor gas lamp, a simple and inexpensive structure for lighting the mantle tips of the lamp.

Other objects, features and advantages of the present invention will become apparent from the following descriptions when considered in conjunction with the accompanying drawing wherein like characters of reference designate corresponding parts throughout the several views.

DETAILED DESCRIPTION OF THE DRAWINGS

DETAILED DESCRIPTION

Figure 1:
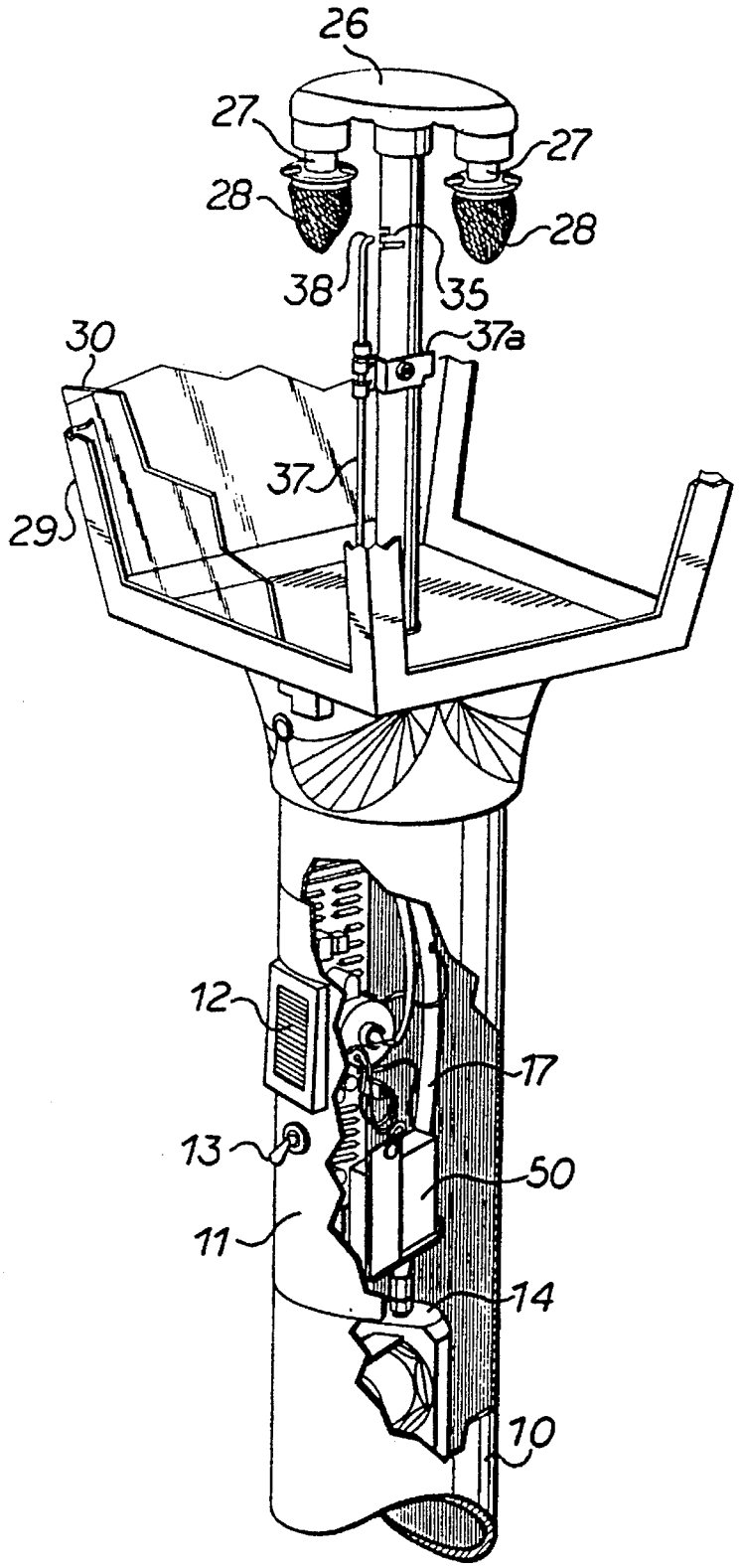
FIG. 1 is a fragmentary perspective view of an outdoor gas lamp constructed in accordance with the present invention.
Figure 4:
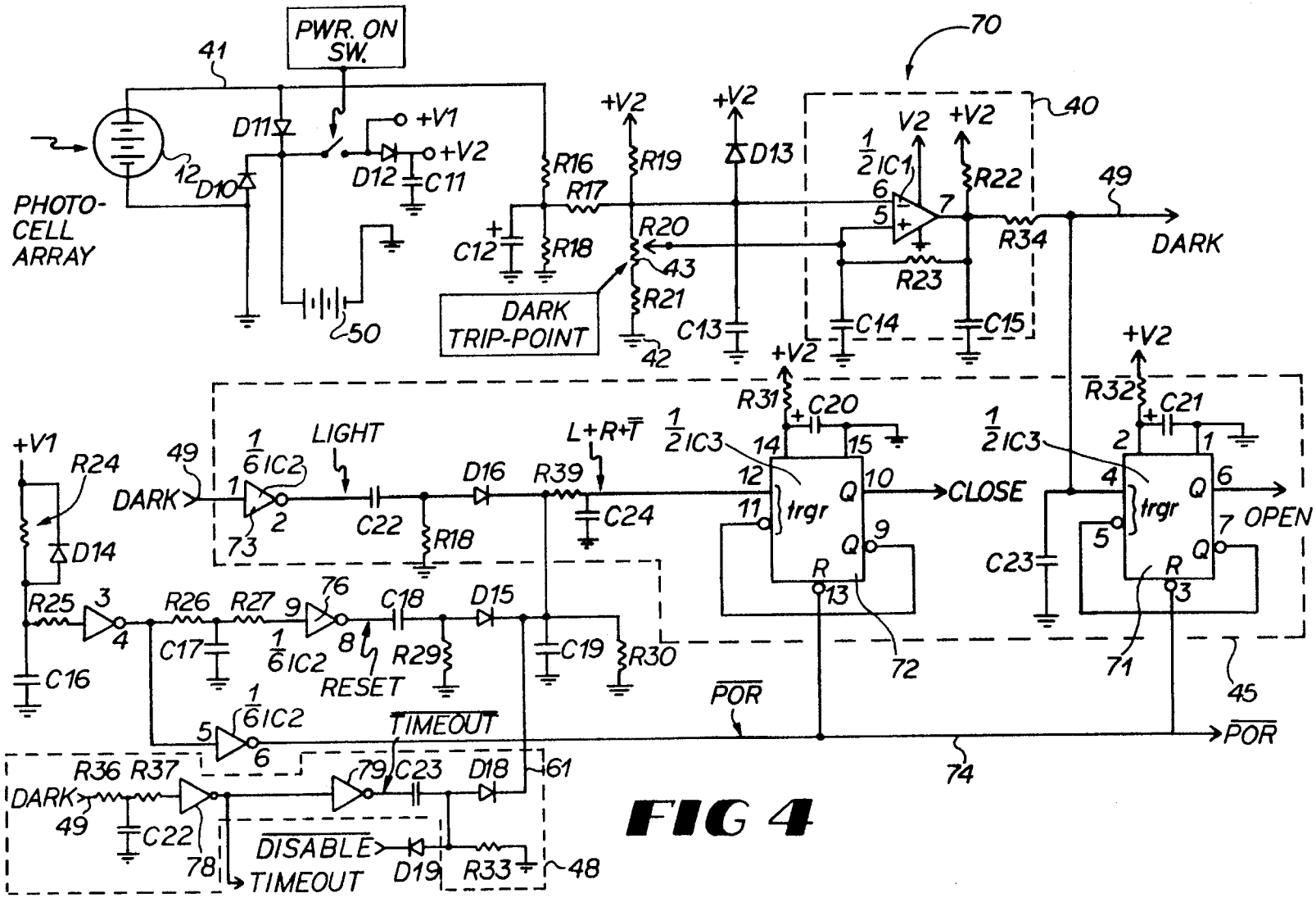
FIGS. 4, 5, 6 and 7 are wiring diagrams of the preferred electrical circuit depicted in FIG. 3

Referring now in detail to the drawings which depict the preferred embodiment of the invention, numeral 10 denotes a hollow, cylindrical, upstanding standard or lamp post 10. Post 10 is provided, at one side, below its upper end, with a removable access door 11 which carries a photogalvanic solar cell or photocell array 12 exposed to ambient light, and also has a manually operated electrical disable switch 13. Within the hollow interior of post 10 is a double acting, solenoid valve 14, provided with a hollow stem 15 through which protrudes a manually operated button control 16 for opening and closing valve 14 manually so that the lamp can be lighted manually when there is a malfunction or the battery 50, seen in FIGS. 1 and 4, is low. Valve 14 communicates with a primary source of illuminating gas (not shown) such as a natural gas line or a propane gas or butane gas source. Valve 14 discharges gas to supply pipe 17, seen in FIG. 1 and 2, which feeds gas through a manual regulator valve 18 to a gas nozzle 20. Nozzle 20, in turn, discharges gas through its central orifice into a mixing chamber 21, provided with circumferential spaced air intake ports 22.

The air and gas are mixed in the mixing chamber 21 into a combustible mixture.

Mounted on the upper end of the mixing chamber 21 is an upstanding, straight, hollow, cylindrical, metal, electrically conducting, venturi tube 25, the lower end portion of which is tapered downwardly to a diverging portion of the chamber 21 to define the venturi. The tube 25 thus receives the combustible mixture of air and gas from the source of air and gas, namely, chamber 21. The upper portion of tube 25 is straight and cylindrical or circular and is provided at its upper end with external threads so as to be threadedly received in an intake port in the central portion of a transversely extending two-way gas manifold or mantle head 26. Thus, the tube 25 and the manifold 26 form a conduit for the gas mixture. The opposed ends of manifold 26 are turned downwardly and are provided with openings which respectively receive the upper ends of inverted, ceramic, tubular, downwardly extending, opposed, burner tips or nozzles 27 disposed on opposite sides of venturi tube 25. The mantles 28 are respectively mounted on the tips or nozzles 27 so that they surround the discharge ends of nozzles 27 and hang pendulent from the nozzles. In its broader aspect, the tube 25 could simply be a conduit with a discharge end which is to be lighted.

The venturi tube 25, manifold 26, tips 27 and mantles 28 are enclosed in a lamp frame 29 containing a plurality of transparent glass windows 30, the frame 29 being supported by the upper end of lamp post 10.

According to the present invention, two parallel narrow openings, slots or slits 35, 36 are cut transversely in the central upper portion of the venturi tube 25. The openings 35, 36 are for the purpose of permitting a small quantity of the combustible gas mixture to migrate from the stream of combustible gas and air outwardly through slits 35, 36 to the outer periphery of the venturi tube 25 so that it is available at the exterior of the venturi tube for being ignited by an electrical spark as will be explained, hereinafter.

The openings 35, 36 are illustrated as being transverse or radial slits or slots which extend around a substantial portion of the tube 25. Preferably, the slits or slots 35, 36 are of uniform width throughout their length, having a width of about 0.018 inches. This width is quite critical in that the slits 35, 36 should be sufficiently wide that, when the mixture is lighted at the exterior or outer periphery of the tube 25, the flame will migrate through the slits 35, 36 and ignite the gas mixture stream within tube 25. The slits 35, 36 should be sufficiently narrow that the leakage of the gas mixture to the exterior is at a minimum. The flow of gas should be insufficient for slits 35, 36 to remain lighted, once the spark is no longer present and once any exterior flame has been quenched, due to the ignition of the gas mixture within venturi tube 25.

Figures 2A, 2B:
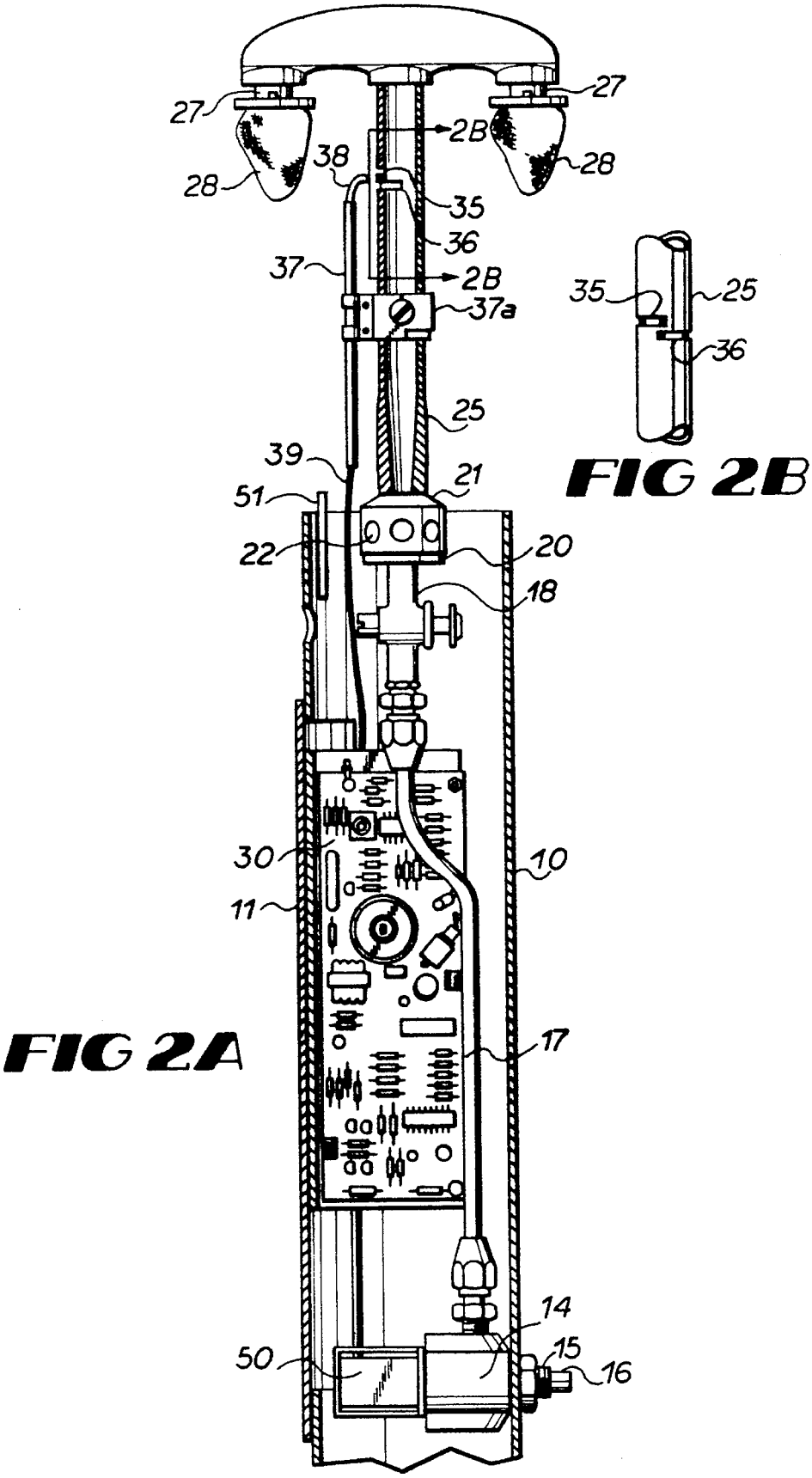
FIG. 2A is a side elevational view, partially in cross-section, showing a portion of the lamp shown in FIG. 1.
FIG. 2B is a side elevational view taken substantially along line 2B—2B in FIG. 2A.

Thus, it is quite critical that, when the openings are to be slit, the width of the slits be from about 0.005 inches to about 0.02 inches and each slit should extend and be continuous along an arc about 110° to 120° around venturi tube 25. Preferably the slits 35, 36 should subtend about 180°. Moreover, the slits 35, 36 are spaced along the longitudinal axis of venturi tube 25 approximately 0.0625 inches apart, their ends overlapping about 0.125 inches, as best illustrated in FIG. 2B.

The feed of the gas through the orifice of nozzle 20 should be adjusted by manual manipulation of valve 18 so that there will be no quenching of the ignited flame within tube 25 and yet the flow of the gas mixture within the venturi tube 25 should be sufficient to prevent appreciable regression of the flame in venturi tube 25, toward the orifice of nozzle 20.

When ignited, the flame produced within the venturi tube 25 travels to the head or manifold 26 and thence, in opposite direction outwardly and downwardly through the tips or nozzles 27, thereby functioning as a pilot light for lighting the emerging gas mixture and keeping the gas lighted at the discharge ends of nozzle 27, in the usual way.

When using natural gas, the orifice of nozzle 20 should be about a Number 73, which burns at about 2,125 BTU per hour. When burning propane, a Number 78 orifice should be used.

The electrically conducting metal venturi tube 25 is electrically grounded via nozzle 20, valve 18, tube 17 and valve 14 to post 10. An upstanding, insulated, electrode cable 37 is mounted adjacent to tube 25, being supported by a bracket **37*a* extending radially from tube 25. At its upper end of cable 37 is a non-insulated metal, inwardly turned electrode tip 38. The tip 38 terminates closely adjacent to the overlapping ends of slits 35, 36 and in close proximity to tube 25, as illustrated in FIG. 2A, for providing therebetween a spark gap. When a sufficiently high voltage potential is applied between electrode tip 38 and tube 25, a spark is generated between tip 38 and tube 25, which is sufficient to ignite the gas mixture passing through slits 35, 36. Wire 39, seen in FIGS. 2 and 3, supplies current to cable 37** for creating the spark.

Figure 3:
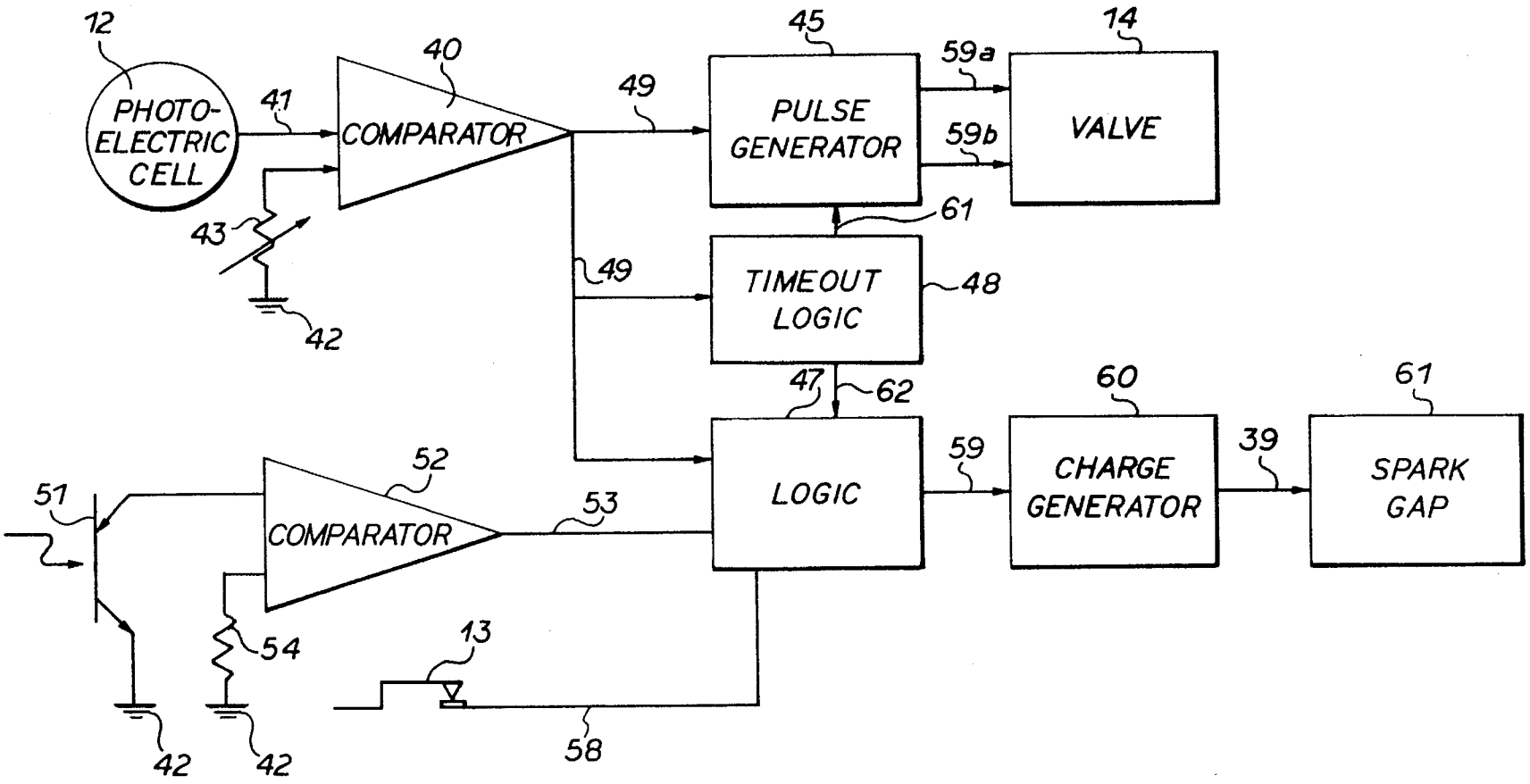
FIG. 3 is a logic diagram of the electrical circuit of the lamp shown in FIGS. 1 and 2.

Retained within the interior of post 10, is an electric circuit board 30 having an electrical circuit therein and electrical elements thereto, which are depicted in the functional block diagram of FIG. 3 and in the wiring diagrams of FIGS. 4 through 7. In FIG. 3, photosensitive cell or solar cell array 12, preferably an electrogalvanic solar cell array, is depicted as providing a signal, via wire 41, to a comparator 40, the comparator 40, grounded at ground 42 through a circuit, including potentiometer or variable resistor 43. The potential generated by the solar cell 12 is compared with a ground potential to provide a relatively high voltage, indicating that it is dark outside, or a relatively low voltage, indicating that there is light outside shining on the solar cell 12.

This potential, high or low, is imposed via wire 49, on a pulse generator 45 which, in turn, supplies a current pulse in one direction to a reversible motor 50, seen in FIG. 1, in order to open the solenoid-controlled valve 14 and in the other direction to close valve 14. Hence, in the daytime the low voltage potential delivered by comparator 40 will cause pulse generator 45 to produce a momentary current to cause the valve 14 to close and remain closed. The high voltage potential from comparator 40 will cause logic 45 to produce a momentary current in the opposite direction to motor 50 and open the valve 14. The setting of potentiometer 43 determines the threshold of light necessary to close and open valve 14. Thus, the function of pulse generator 45 is to provide short pulses to the motor 50 in response to signals output from the comparator 40.

With respect to generating a spark for lighting the illuminating gas mixture, logic 47 monitors the signal from the comparator 40 and, when the voltage from comparator 40 is high (a dark signal), the logic 47 triggers a charge generator 60 which enhances the voltage and current from battery 50 to generate a high voltage potential on the electrode tip 38 and thereby provide a spark at the gap between tip 38 and tube 25.

For disabling the logic 47 to interrupt the spark once the burner tips 27 have been lighted, an infrared sensor 51 is provided, within the post 10 facing upwardly toward one of the mantles 28. The sensor 51 is preferably a light receiving photodiode, the anode of which is grounded at ground 42 and the cathode of which is connected to one terminal of a comparator 52, the other terminal of the comparator 52 being grounded through resistor 54 to ground 42. When the sensor 51, such as phototransistor Q7, detects the light from a mantle 28, it triggers the comparator 52 which sends a signal, via wire 53, to logic 47 to interrupt the modulated current to the primary transformer T1 in logic 47 and, hence, interrupt the spark between tip 38 and tube 25.

If sensor 51 does not defect light from mantles 28 within approximately 60–100 seconds from when electrode tip 38 begins to spark against tube 25, the timeout logic 48 sends a signal to logic 47 to interrupt the sparks between tip 38 and tube 25. Further, timeout logic 48 substantially simultaneously sends a signal to pulse generator 45 to close valve 14. Thus, timeout logic 48 prevents running down battery 50 and the continuous emission of gas when mantles 28 are not lighting.

The manual disabling switch 13, which is in parallel with wire 53, will also disable, via line 58 and logic 47, the spark, thereby serving as a reset switch.

Once the burner tips 27 have been lighted, and the spark is disabled, the lamp remains lighted until the photosensitive cell array 12, receives sufficient light, for example, at dawn, to dictate that the voltage go low on wire 49, thereby directing, via logic 45, that the motor 50 close valve 14.

It is therefore seen that, with very little electricity from battery 50, the outdoor gas lamp of the present invention will automatically light itself at night and remain lighted throughout the night. Then, at dawn, the lamp will automatically shut itself off until night when its cycle is repeated.

The best mode presently known to the inventors for implementing of the circuit, as set forth in FIG. 3, will now be described relative to FIGS. 4 through 7. Referring to circuit 70 of FIG. 4, the photocell array 12 is configured to serve two functions. During the daytime hours, the photocell array 12 recharges the battery 50, via diode D11, and it further serves as a nighttime detector for signalling ignition of gas when it becomes dark outside.

Battery B1, denoted by reference numeral 50 in circuit 70 of FIG. 4, provides a high current voltage source V1 and a low current voltage source V2, which is filtered via a capacitor C11. Voltage source V1 supplies voltage to those electrical elements which require high current, for example, the spark gap 61 (FIG. 6) and the valve control circuit 80 (FIG. 5), as will be further described, hereinafter. Further, the voltage source V2 supplies voltage to the other low current electrical components of the circuit, for example, logic, comparators, and one-shot devices.

The photocell array 12 alerts the circuit 70 when it becomes dark outside by reducing the voltage applied to the inverting terminal (–) of comparator 40 via the voltage divider R16, R18. The capacitor C12 stabilizes the voltage output from the voltage divider R16, R18 and forwarded to the comparator 40. When the voltage input to the inverting terminal is reduced below the reference voltage at the non-inverted terminal (+), then the DARK signal output from the comparator 40 exhibits a logic high (in Boolean logic, "1"). Otherwise, the DARK signal exhibits a logic low (in Boolean logic, "0"). The reference voltage supplied to the non-inverting terminal of the comparator 40 is generated by a voltage divider R19, R20, R21 and is adjusted via the variable resistor R20, as shown in FIG. 4.

When the DARK signal transforms from a logic low to a logic high, a one-shot device 71, which is preferably a CMOS device and which is connected to the comparator 40 via a resistor R34, initiates an OPEN signal. In the preferred embodiment, the OPEN signal is essentially a 100 millisecond pulse. This pulse is applied to the valve control circuit 80 (FIG. 5) associated with the gas valve 14, which will be fully described hereinafter.

With reference to FIG. 4, the DARK signal is further provided to a one-shot device 72, preferably a CMOS device, via an inverter 73, a differentiator C22, R18, and a diode D16, which is part of a diode OR-configuration D15, D16, D18. When the DARK signal exhibits a logic low, the one-shot device 72 initiates a CLOSE signal to the valve control circuit 80 (FIG. 5) associated with the gas valve 14 for terminating gas flow. In the preferred embodiment, the CLOSE signal is essentially a 100 millisecond pulse adapted to close the gas valve 14.

In order to ensure proper initialization of the circuitry, a POWER-ON-RESET (POR) signal is initially applied to the one-shot devices 71, 72, which initially disables the one-shot devices 71, 72 for a short time period, such as approximately 7 seconds, for the purpose of permitting the circuitry to stabilize and reach an equilibrium (steady state) condition. The POR signal is applied to the one-shot devices 71, 72 via an inverse ($\overline{POR}$) line 74. After the 7 second time period, the POR signal is forced to a logic low as a result of charging of capacitor C16 via voltage V1 through resistor R24. Moreover, concurrently with the withdrawal of the POR signal, the output of an inverter 76 is driven to a logic high, is passed through a differentiator C18, R29, and is ultimately sent to the one-shot device 72 via the diode OR-configuration D15, D16, D18. This predicament causes the one-shot device 72 to initiate a CLOSE signal to ensure that the gas valve 14 is initially closed.

Gas valve 14 also closes after a predefined time delay, such as approximately 60 to 100 seconds, after opening if the spark between electrode tip 38 and tube 25 does not ignite the gas mixture passing through slits 35, 36. When the DARK signal transforms from logic low to a logic high, capacitor C22 of timeout logic 48 begins to charge as valve 14 is opened by one-shot device 71 and a high voltage potential is generated across spark gap 61 by charge generator 60. If the gas mixture is not ignited by the time capacitor C22 fully charges, the output of inverter 78 is driven low, driving the output of inverter 79 high. The high output of inventer 79 is passed through a differentiator C23, R38, and is ultimately sent to the one-shot device 72 via the diode OR-configuration D15, D16, D18, closing valve 14. If the gas mixture ignites before capacitor C22 charges, the ignition detection circuit 90, described in detail hereinafter, communicates a $\overline{DISABLE}$ signal to timeout logic 48 to prevent the timeout logic 48 from closing of valve 14 via one-shot device 72. Thus, the gas valve 14 is closed after a time delay defined by capacitor C22 if the gas mixture in tube 25 does not ignite so as to prevent the unecessary discharge of gas.

To further ensure that the one-shot devices 71, 72 are not triggered by stray noise and the like, the capacitor 23 is attached to the input of one-shot device 71, and capacitor C24 and resistor R30 are attached to the input of one-shot device 72. The foregoing circuit elements essentially filter out noise and other potential electrical transients which may undesirably trigger these one-shot devices 71, 72, resulting in system failure.

Figure 5:
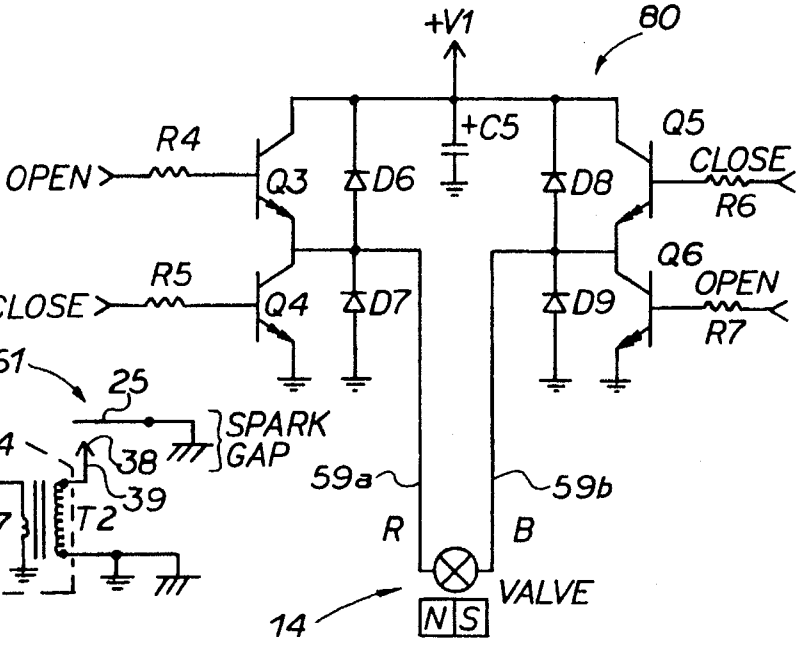

FIG. 5 shows the valve control circuit 80 which receives the OPEN signal and the CLOSE signal, both output by respective one-shot devices 71, 72. The valve control circuit 80 of FIG. 5 is known in the industry as an H-bridge circuit. The valve control circuit 80 is designed to provide a pulse to the valve 14 in one of two possible polarities. One polarity causes the valve 14 to open, whereas the other polarity causes the valve 14 to close. More specifically, when the OPEN signal is received, transistors Q3, Q6 are turned on. Accordingly, current flows through resistor R4, transistor Q3, valve 14, and through transistor Q6 to ground. Furthermore, when the CLOSE signal is received, the transistors Q4, Q5 are turned on, resulting in a current flow through resistor R6, transistor Q5, valve 14, and transistor Q4 to ground. The current flow through the valve 14 is generally 400 to 500 mA for a duration of approximately 100 ms for either the open or close predicament. It should be further noted that the transistors Q3–Q6 in FIG. 5 are Darlington transistor pairs (as indicated by a double arrow at the transistor collector), which are generally low power, but have a high gain characteristic.

Figure 6:
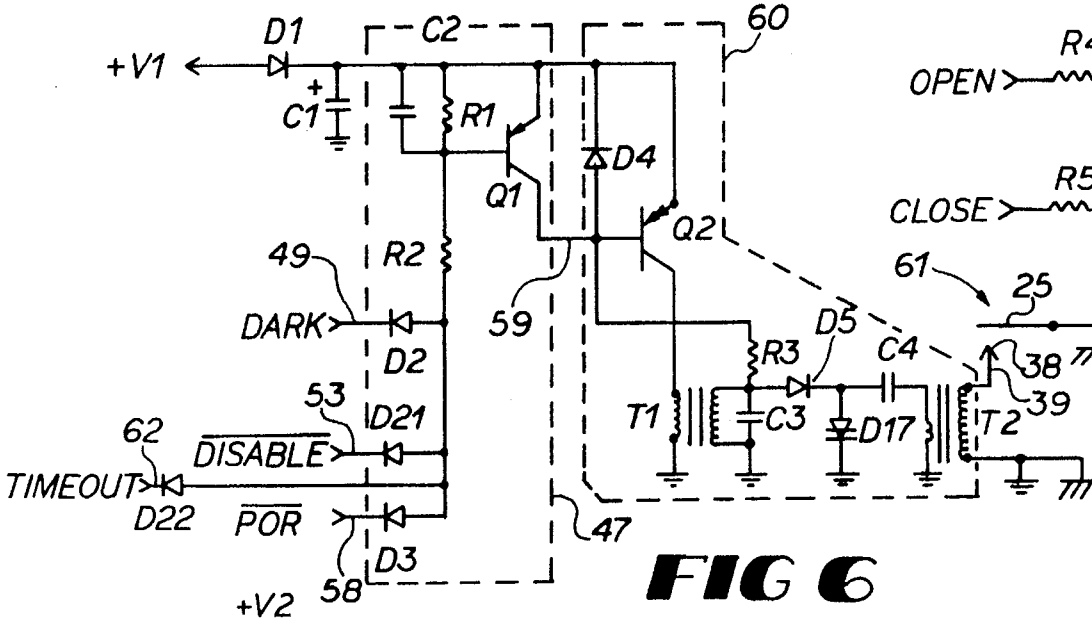

The charge generator 60 of the preferred embodiment is shown in detail in FIG. 6. With reference to FIG. 6, the charge generator 60 comprises an oscillating resistor Q2 which is switched to an on or off state by a transistor Q1. As the transistor Q2 oscillates, the current in the primary coil of transformer T1 fluctuates and thereby generates a sinusoidal signal on the secondary coil of the transformer T1. The sinusoidal signal across the capacitor C3 is approximately 300 volts in terms of peak-to-peak voltage. The diode D5 rectifies this sinusoidal signal, resulting in the generation of a wave form having a peak-to-ground voltage of approximately 150 volts. This signal charges the capacitor C4. A trigger diode D17 is situated between the input to the capacitor C4 and ground and is designed to dump charge to ground when the potential across the diode D17 reaches approximately 150 volts. Thus, as the capacitor C4 is charged, the voltage potential across the diode D17 begins to increase, and after the capacitor C4 stores enough charge, the diode D17 dumps the charge from the capacitor C4 to ground.

As the diode D17 dumps charge, the current on the primary coil of transformer T2 fluctuates, thereby generating a high current in the secondary coil in transformer T2 and a high potential difference in the spark gap 61. In the preferred embodiment, the voltage generated across the spark gap is approximately 15 to 20 killivolts. Further, once the charge generator 60 begins to oscillate, the spark gap 61 sparks between 3 and 10 times per second, unless the charge generator 60 is disabled, as will be further described below.

The charge generator 60 of FIG. 6 is disabled by turning off the transistor Q1, which deprives current from the base of transistor Q2. The transistor Q1 is turned off during the daytime and is permitted to turn on during the nighttime via the DARK signal applied to transistor Q1 through the diode D2 and resistor R2. The transistor Q1 is also turned off initially during the initialization phase of the circuit, as described previously with respect to FIG. 4. This feature is accomplished by applying the $\overline{\text{POR}}$ signal to the transistor Q1 via a diode D3 and a resistor R2. Furthermore, the transistor Q1 may be turned off after the gas has been ignited by spark gap 61 by way of an ignition detection circuit 90 of FIG. 7 which generates a $\overline{\text{DISABLE}}$ signal. If the ignition detection circuit 90 does not turn off transistor Q1 within the predefined time delay of timeout logic 48, the transistor Q1 is turned off by the Timeout signal from timeout logic 48, thereby stopping the sparking of sparks gap 61.

Figure 7:
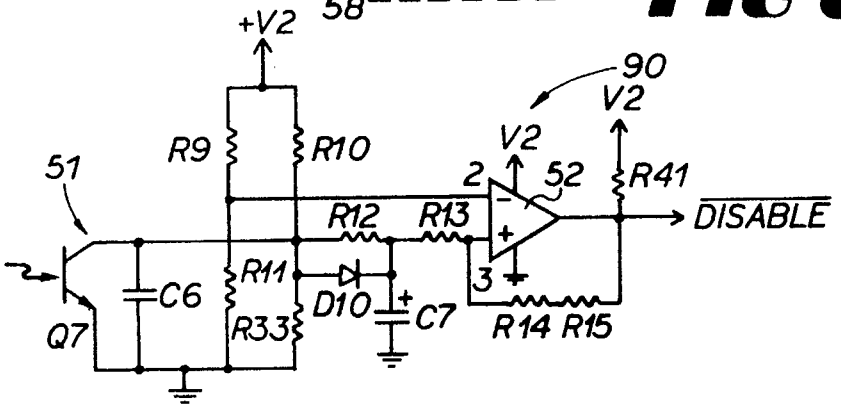

As shown in FIG. 7, the ignition detection circuit 90 comprises a phototransistor Q7 which is sensitive to infrared radiation emitted by a burning flow of gas. The corona discharge which is generated by the spark gap 61 does not generate enough infrared radiation in order to switch on the phototransistor Q7. However, once the gas flow is ignited and the transistor Q7 is turned on, the non-inverting input (+) to the comparator 52 is driven to a voltage potential which is less than the reference voltage applied to the inverting terminal (–) of the comparator 52. In this event, the $\overline{\text{DISABLE}}$ signal is generated at the output of the comparator 52 and is applied to the charge generator circuit 60 of FIG. 6 in order to turn off the transistor Q1 and accordingly the sparking of the spark gap 61. Additionally, the $\overline{\text{DISABLE}}$ signal is applied to the timeout logic circuit of FIG. 4 to prevent the closing of valve 14.

The signal applied to the non-inverting terminal of the comparator 52 is delayed to a certain extent by resistors R11 and R12 so as to ensure that the gas flow is ignited for a time period before the sparking is terminated. Further, the reference voltage applied to the inverting terminal of the comparator 52 is generated by the voltage divider R9, R11, having applied voltage V2.

It will be obvious to those skilled in the art that many variations be made in the embodiment here chosen for purposes of disclosing the preferred embodiment of my invention.

We claim:

1. An improvement for a gas lamp comprising a conduit having an intake end and a discharge end, means for supplying a stream of a combustible mixture of gas and air through said conduit from said intake end to said discharge end, burner tip means communicating with said discharge end and through which said gas passes for burning at said burner tip means, the improvement comprising:

(a) said conduit being provided with an opening intermediate its ends;

(b) an electrical electrode disposed adjacent to the exterior of said conduit and adjacent to said opening;

(c) an electrical circuit electrically connected to said electrode and said conduit for providing an electrical potential between said electrode and said conduit, said electrical potential being sufficient to provide an electrical spark in the vicinity of said opening; and (d) said opening being of a size sufficient to permit the combustible mixture within said conduit to light so that said combustible mixture as discharged through said burner tip means is ignited.

2. The gas lamp defined in claim 1 wherein said opening is a slit extending through said conduit.

3. The gas lamp defined in claim 2 wherein said slit has a width of approximately 0.018 inches.

4. The gas lamp defined in claim 2 wherein said slit has width of between 0.005 inch and 0.019 inch.

5. The gas lamp defined in claim 1 wherein said conduit includes a cylindrical tube and said opening is a slit extending approximately 115° around said tube.

6. The gas lamp defined in claim 2 wherein said slit is approximately 0.018 inches in width, said conduit includes a circular tube and said slit extends circumferentially around said circular tube.

7. The gas lamp defined in claim 6 wherein said slit extends approximately 115° around said tube.

8. The gas lamp defined in claim 1, further comprising a second opening in said conduit intermediate its ends.

9. The gas lamp defined in claim 8, wherein said second opening is a slit extending through said conduit.

10. The gas lamp defined in claim 8, wherein said slits are longitudinally spaced along the central axis of said tube between 0.03125 and 0.125 inches apart.

11. The gas lamp defined in claim 8, wherein said conduit includes a cylindrical tube and said slits extend approximately 115° around said tube, said slits overlapping between 0.0625 and 0.25 inches.

12. The gas lamp defined in claim 1, wherein said conduit includes an upright tube having an upstream end and a discharge end and also includes a transverse manifold communicating with said discharge end, said manifold having a pair of opposed discharge ports disposed on opposite sides of said upright tube, and said burner tip means includes a pair of downwardly protruding burner tips respectively communicating with said discharge ports, said opening being in said tube so that the combustible mixture is lighted in said tube by said electrical spark and travels along a portion of said tube and through said manifold for lighting the combustible mixture as it is discharged from said burner tips, and including mantles surrounding the discharge ends of said burner tips.

13. A gas lamp, comprising:

(a) conduit means through which combustible illuminating gas and air travels;

(b) delivery means for said combustible illuminating gas and air connected to said conduit means for delivering a stream of said combustible gas and air to said conduit means;

(c) ignition means for igniting said stream of combustible gas and air within said conduit;

(d) a pair of mantle tips communicating with said conduit and through which said combustible gas and air is discharged in an ignited condition when said combustible gas and air has been ignited;

(e) a photoelectric cell for detecting dark and light ambient conditions;

(f) an electro-mechanical valve for controlling the delivery of said gas to said delivery means, said valve having an open condition in which gas is delivered to said delivery means and a closed condition in which gas is precluded from being delivered to said delivery means;

(g) an electrical circuit connected to said ignition means, said photoelectric cell, and said valve; and (h) said photoelectric cell generating different signals during dark ambient conditions and light ambient conditions, said electrical circuit actuating said valve so that it remains open during periods of darkness and so that it remains closed during periods of daylight.

14. The gas lamp defined in claim 13, wherein said electrical circuit includes an electrode having an electrode tip and wherein said conduit means includes a portion thereof which is electrically conducting, said electrode tip being spaced from said portion for providing a spark gap therebetween, said electrical circuit opening said valve and for imposing a potential between said electrode tip and said portion for igniting said combustible illuminating gas and air passing through said conduit before said combustible mixture is discharged from said tips for lighting the combustible mixture thereafter being discharged.

15. The gas lamp defined in claim 14 further comprising a sensor for sensing light produced as a result of the gas being lighted at said tips and for causing said electrical circuit to disable said ignition means when said tips are lighted.

16. The gas lamp defined in claim 13, further comprising a timeout circuit for closing said valve and disabling said ignition means when said gas has not ignited within a predefined time period.

17. A system for automatically operating a gas lamp, comprising:

a burner associated with the gas lamp for burning gas;

a valve for controlling the flow of said gas to said burner;

a spark gap associated with said burner for igniting said gas;

a photoelectric cell for detecting atmospheric light and generating different signals during dark ambient conditions and light ambient conditions;

a sensor associated with said burner for detecting light emitted produced as a result of the ignited gas;

an electric circuit for receiving a signal from said photoelectric cell for actuating an electrical potential at said spark gap;

an electrical circuit for receiving a signal from said photoelectric cell for actuating said valve.

an electrical circuit for closing said valve and disabling said electrical potential when said gas does not ignite after a predefined time period; and an electrical circuit for receiving a signal from said sensor and disabling said electrical potential when said gas is ignited.

18. A method for producing an automatic control mechanism for a gas lamp comprising a conduit having an intake end and a discharge end, means for supplying a stream of a combustible mixture of gas and air through said conduit from said intake end to said discharge end, burner tip means communicating with said discharge end and through which said gas passes for burning at said burner tip means, the method comprising the steps of:

(a) forming an opening intermediate said ends of said conduit;

(b) disposing an electrode adjacent to said opening;

(c) connecting an electrical circuit to said electrode and said conduit for providing an electrical potential between said electrode and said conduit, said electrical potential being sufficient to provide an electrical spark in the vicinity of said opening; and (d) forming said opening of a size sufficient to permit the combustible mixture within said conduit to light so that said combustible mixture as discharged through said burner tip means is ignited.

19. The method defined in claim 18, further comprising a second opening intermediate said ends of said conduit.

20. A method for producing an automatic control mechanism for a gas lamp, comprising the steps of:

(a) providing a conduit means through which combustible illuminating gas and air travels;

(b) connecting a delivery means to said conduit means, said delivery means for delivering a stream of said combustible gas and air to said conduit means;

(c) disposing an ignition means within said conduit for igniting said stream of combustible gas and air within said conduit;

(d) disposing a pair of mantle tips in communication with said conduit and through which said combustible gas and air is discharged in an ignited condition when said combustible gas and air has been ignited;

(e) disposing a photoelectric cell for detecting dark and light ambient conditions, said photoelectric cell generating different signals during dark ambient conditions and light ambient conditions;

(f) disposing an electro-mechanical valve for controlling the delivery of said gas to said delivery means, said valve having an open condition in which gas is delivered to said delivery means and a closed condition in which gas is precluded from being delivered to said delivery means; and (g) connecting an electrical circuit to said ignition means, said photoelectric cell, and said valve, said electrical circuit actuating said valve so that it remains open during periods of darkness and so that it remains closed during periods of daylight.

21. A gas lamp comprising:

(a) a conduit having an intake end into which is introduced a combustible mixture and a discharge end through which said combustible mixture is discharged; said combustible mixture passing as a stream through said conduit from said intake end to said discharge end; and (b) An electrical circuit intermediate the ends of said tube for generating an electrical spark for igniting said combustible mixture within said conduit as said combustible mixture passes along said conduit so that after being ignited the ignited combustible mixture travels out of said discharge end of said conduit and lights the stream of combustible mixture for burning at said discharge end.

22. The gas lamp defined in claim 21 including a mantle on said discharge end for being heated to incandescence.

23. The gas lamp defined in claim 21 wherein said conduit is provided with an opening intermediate its ends and said electrical circuit creates said spark externally of said conduit and adjacent to said opening.

24. The gas lamp defined in claim 21, wherein said conduit is provided with an ignition opening intermediate its ends, said opening communicates with said combustible mixture in said tube, and said electrical circuit creates said spark externally of said conduit and adjacent to said ignition opening.

* * * * *